US009856647B1

(12) United States Patent
Kim et al.

(10) Patent No.: US 9,856,647 B1
(45) Date of Patent: Jan. 2, 2018

(54) NON-WELDING TYPE CONCRETE-FILLED STEEL TUBE COLUMN USING STRAIGHT BOLT CONNECTION SLOT AND WAVE-SHAPED PUNCHING STEEL PLATE AND METHOD OF CONSTRUCTING THE SAME

(71) Applicant: KOREA INSTITUTE OF CIVIL ENGINEERING AND BUILDING TECHNOLOGY, Gyeonggi-do (KR)

(72) Inventors: Heung Youl Kim, Seoul (KR); Bum Yeon Cho, Seoul (KR)

(73) Assignee: KOREA INSTITUTE OF CIVIL ENGINEERING AND BUILDING TECHNOLOGY, Gyeonggi-Do (KR)

( * ) Notice: Subject to any disclaimer, the term of this patent is extended or adjusted under 35 U.S.C. 154(b) by 0 days.

(21) Appl. No.: 15/371,171

(22) Filed: Dec. 6, 2016

(30) Foreign Application Priority Data

Jul. 15, 2016 (KR) ..... 10-2016-0089904

(51) Int. Cl.

| | |
|---|---|
| ***E04C 3/34*** | (2006.01) |
| ***E04B 1/94*** | (2006.01) |
| ***E04C 3/36*** | (2006.01) |
| ***E04C 3/32*** | (2006.01) |

(52) U.S. Cl.
CPC ..... *E04C 3/34* (2013.01); *E04B 1/943* (2013.01); *E04C 3/32* (2013.01); *E04C 3/36* (2013.01); *Y10T 29/49631* (2015.01)

(58) Field of Classification Search
CPC ..... E04C 3/34; E04C 3/36; E04C 3/32; Y10T 29/49631
USPC ..... 52/223.4, 834, 835, 843, 844, 845
See application file for complete search history.

(56) References Cited

U.S. PATENT DOCUMENTS

| | | | | |
|---|---|---|---|---|
| 4,864,797 A | | 9/1989 | Sato et al. | |
| 6,048,594 A | * | 4/2000 | Greene | E04C 3/34 428/34.5 |
| 7,464,512 B1 | * | 12/2008 | Perina | E04H 12/08 52/651.01 |
| 2013/0133278 A1 | | 5/2013 | Kim et al. | |

FOREIGN PATENT DOCUMENTS

| | | | | |
|---|---|---|---|---|
| DE | 102005053342 | * | 5/2007 | E04C 3/34 |
| GB | 794513 A | * | 5/1958 | E04B 1/165 |
| KR | 100991337 | | 11/2010 | |
| KR | 101611868 | | 4/2016 | |
| WO | WO 03102317 A1 | * | 12/2003 | E04B 1/165 |
| WO | WO 2015147414 A1 | * | 10/2015 | E04C 3/293 |

* cited by examiner

*Primary Examiner* — Adriana Figueroa
(74) *Attorney, Agent, or Firm* — JCIPRNET

(57) ABSTRACT

In the disclosure, the CFT column includes external steel tubes including straight jointing portions in which inclined bolt grooves are formed to be vertically apart from each other and which are formed to extend from an end thereof to cover an overall extension length thereof, a straight bolt connection slot including straight plates connected by a connection bolt to be apart from each other and formed to extend, and configured to integrate the external steel tubes by allowing the connection bolt to be inserted into each of the inclined bolt grooves in which the straight jointing portions of the external steel tubes are in contact with each other and communicate with each other, concrete placed in the integrated external steel tubes and cured, and a wave-shaped punching steel plate.

6 Claims, 9 Drawing Sheets

NON-WELDING TYPE CONCRETE-FILLED STEEL TUBE COLUMN USING STRAIGHT BOLT CONNECTION SLOT AND WAVE-SHAPED PUNCHING STEEL PLATE AND METHOD OF CONSTRUCTING THE SAME

CROSS-REFERENCE TO RELATED APPLICATION

This application claims priority to and the benefit of Korean Patent Application No. 2016-0089904, filed on Jul. 15, 2016, the disclosure of which is incorporated herein by reference in its entirety.

BACKGROUND

1. Field of the Invention

The present invention relates to a concrete-filled steel tube (CFT) column, and more specifically, to a non-welding type CFT column using a straight bolt connection slot for assembling the CFT column in a non-welding method and a wave-shaped punching steel plate for easily ensuring a water path in concrete, and a method of constructing the same.

2. Discussion of Related Art

A concrete-filled steel tube (CFT) column is a structure in which an enclosed-type steel tube column is filled with concrete. This structure is structurally stable in terms of stiffness, yield strength and transformation and has an excellent advantage with respect to fire resistance, construction and the like.

The CFT column, which is a closed section member, has a steel tube formed on the outside thereof to withstand against a bending moment and concrete formed in the inside thereof to withstand an axial force so that the steel tube restricts the internal concrete or the concrete prevents local buckling of the steel tube from occurring. Due to the above effects, the CFT column is advantageous in that, compared with other structures, strength and an energy absorbing capacity are excellent.

Since the steel tube, which is a material of the CFT column, should be fabricated through a welding process at a large-scale factory provided with specific manufacturing facilities, the CFT column has a problem of excessive manufacturing cost.

Meanwhile, FIG. 1A is a view illustrating a shape of a test specimen of a conventional CFT column.

FIG. 1A illustrates that the CFT column is fabricated as a test specimen. The CFT column used as the test specimen 1 is constructed as a structure including an upper cover plate, an end plate, concrete, steel and so on. The CFT column test specimen is formed by placing concrete on an upper side of the CFT column test specimen, curing the concrete, grinding a surface of the concrete, and then welding the upper end plate.

In the case of the CFT column, a loading axial force, column strength, a sectional size and a boundary condition may be considered as parameters influencing fire resistance capacity. When a degree with respect to the four factors influencing fire resistance capacity was analyzed, for example, as a result of the analysis of the fire resistance according to a loading axial force ratio under a concrete strength condition (360-24-0.9), wherein the concrete had a cross-section of 360×360×9 mm and a strength of 24 MPa, in the case of the axial force ratio of 0.9 calculated only with concrete strength, the fire resistance exceeded a standard at 33 minutes, the deformation amount was 16.2 mm, and the deformation ratio was 13 mm/min.

Also, in the case of an axial force ratio of 0.6 (360-24-0.6), it was deduced that the fire resistance exceeded deformation amount allowance at 106 minutes, the maximum deformation amount was 10.5 mm, and the deformation ratio was 0.5 mm/min.

Also, in the case of an axial force ratio of 0.2 (360-24-0.2), it was measured that fire resistance of 180 minutes was ensured.

This was determined to be because expansion of the CFT column by the steel tube, a restriction effect by the bolt under the condition of the fixed end, and load dispersion by thermal expansion of concrete occurred.

In this case, a result of the comparison of the fire resistance according to the axial force ratio shows that the fire resistance of about 70 minutes can be ensured when the axial force rate is adjusted from 0.9 to 0.6 and the fire resistance of a maximum of 180 minutes can be ensured based on KS F 2257-1 when the axial force ratio is adjusted to less than or equal to 0.2.

Further, in the conventional CFT column structure, since an external wall is formed of an enclosed-type thin steel plate, most heat is transmitted into concrete through the thin steel plate in fire, and thus the pressure of steam is sharply increased by the moisture in the concrete. Therefore, there was a problem of causing deformation of the CFT column.

Meanwhile, the high-strength concrete has a problem of generating spalls caused by vapor in the concrete, and due to the spalling, the steel tube on which a plurality of welding points are exposed has a problem of extreme vulnerability to fire.

FIG. 1B is a view illustrating a prefabricated enclosed-type steel frame member using a bending-formed steel plate according to a conventional art.

That is, the prefabricated enclosed-type steel frame member 20 using a bending-formed steel plate according to the conventional art is characterized in that a plurality of unit members 20*a* obtained by bending-forming the steel plate are assembled to complete an enclosed-type hollow steel frame member having a circular or square tube section.

In other words, the steel plate is bending-formed to provide the plurality of unit members 20*a*, each of which includes a face-forming part 21*a* formed by bending a steel plate to have a shape coinciding with a portion of a section of the tube, and bending portions 22*a* formed by bending both end portions of the face forming part 21*a* toward an inner side of the tube.

The bending portions 22*a* of adjacent unit members 20*a* are in contact with each other, and the bending portions are then welded to each other to form the hollow steel frame member having an enclosed section.

In a unit member 20*a*, at this time, a bending corner at which the face-forming part 21*a* meets the bending portion 22*a* is naturally machined into a rounded shape during a process of bending a steel plate. When the unit members 20*a* are disposed such that the bending portions 22*a* are in contact with each other, a portion at which the bending corners meet is formed into a depression portion 23*a* which is dented with respect to the face-forming portion 21*a*.

However, the prefabricated enclosed-type steel frame member using a bending-formed steel plate according to the conventional art has the structure in which four L-shaped unit members are connected and welded. Due to melting of a welding agent on the welding portion which is most vulnerable in fire, the welding portion is broken and thus the steel tube can burst.

As another conventional art, Korean Registered Patent No. 10-991337 discloses an invention entitled "Method of manufacturing a hollow CFT column using a rib steel tube."

In a centrifugal hollow rib steel tube CFT 30 according to the conventional art, like a concrete file, a wire mesh is inserted into a steel tube, and concrete is then placed in the steel tube. Subsequently, the concrete is compressed by centrifugal force to form a hollow circular section.

At this time, both end portions of each of a pair of semi-cylindrical steel tubes are bent toward a semi-circular inside to form a "⊏"-shaped rib. When two semi-cylindrical steel tubes are stood to face each other to form a cylindrical steel tube, a pair of small C-section steels are fitted to allow each C-section steel to tie one pair of ribs so that two semi-cylindrical steel tubes are constructed into one cylindrical steel tube.

In the centrifugal hollow rib steel tube CFT according to the conventional art, however, the method of coupling only the steel tubes itself has problems of low coupling force and small coupling depth in the concrete. In addition, restriction obtained by only the C-section steel can cause a burst of the CFT column steel tube due to a concentration of internal pressure in the concrete on an external steel tube in fire.

Therefore, still another conventional CFT column is disclosed in FIG. 1C.

That is, as shown in FIG. 1C, a non-welding type CFT column 50 using a slot is disclosed. The non-welding type CFT column 50 using a slot includes an external steel tube 51 formed of an integrated steel plate and bent and retracted to allow a jointing portion of both end faces thereof to be formed into a T-shaped bending part, the external steel tube having a multi-perforated penetrating part 52 formed thereon, a slot 54 having a shape corresponding to the shape of the T-shaped bending part to allow the T-shaped bending part to be inserted thereinto, a restricting unit 55 restricting the T-shaped bending part 53, and concrete 56 placed in the external steel tube and cured in a state in which the T-shaped bending part is inserted into the slot. The external steel tube 51 is jointed through the slot 54 in a non-welding manner.

Therefore, the jointing ends of the external steel tube are bent and retracted to be formed as the T-shaped bending part, and the slot is inserted into the T-shaped bending part in a sliding manner so that construction can be performed without welding. Accordingly, since a welding process is omitted, the time required for constructing the CFT column can be reduced. The multi-perforated penetrating part is formed in the external steel tube of the CFT column to secure a fire resistance capacity of the CFT column.

However, even if a thin plate is used for the slot 44, a predetermined bending machine is required to bend the thin plate into a E-shape with a predetermined inner space, but great costs and effort are actually required to manufacture the bending machine which is possible for quality control. Therefore, there was a problem of difficulty of manufacturing a CFT column.

Further, a non-welding type CFT column using another connection slot is also disclosed (Korean Patent No. 10-1611868, CONCRETE FILLED TUBE OF NON-WELDING USING BUILT-IN SLOT).

That is, as shown in FIG. 1D, the CFT column 10 includes an external steel tube 11 bent and retracted to allow a jointing portion of jointing ends on both cross-sections thereof to be formed into a T-shaped bending part 13, the external steel tube having a multi-perforated penetrating part 12 formed thereon; a connection slot 14 having a shape corresponding to the shape of the T-shaped bending part to allow the T-shaped bending part 13 to be inserted thereinto; and concrete placed in the external steel tube and cured in a state in which the T-shaped bending part 13 is inserted into the connection slot. The external steel tube 11 is jointed through the connection slot 14 in a non-welding manner.

The connection slot 14 includes two first jointing plates 15 disposed horizontally apart from each other so that a space S is formed by a bearing 17 installed between the first and second jointing plates 15 and 16, which are apart from each other, and the bent jointing end E of the external steel tube is horizontally inserted into the space S, the second jointing plate 16 disposed to form a space between the second jointing plate 16 and the first jointing plate 15 by the bearing 17, and connection bolts 18 allowing a bolt part to be fixed to the second jointing plate 16 by nuts 19 through the bearing 17 formed between the first and second jointing plates.

However, since the plurality of connection bolts 18 and the nuts 19 are fastened and installed one by one, an actual work space is small, which reduces work efficiency. Thus, a non-welding type CFT column using a connection slot which is able to be manufactured in a simpler form and more easily control spall is required.

Further, the plurality of multi-perforated penetrating parts 12 are formed in an external steel tube 11, and the multi-perforated penetrating parts 12 have to function as an inner water path when jointed with concrete. Concrete around the actual multi-perforated penetrating parts 12 is close to a surface exposed to flames, and thus the concrete is vulnerable and reinforcement is required. However, the external steel tube 11 is generally manufactured of a thin plate, and a unit is required to solve this problem.

SUMMARY OF THE INVENTION

The present invention is directed to a non-welding type concrete-filled steel tube (CFT) column using a straight bolt connection slot capable of constructing both external steel tubes in a non-welding manner by allowing jointing portions of the external steel tubes of the CFT column to be bent and retracted to be straightly in contact with each other and then simply inserting a straight bolt connection slot horizontally fastened with the connection bolt into inclined bolt grooves of the jointing portions of the external steel tubes to be integrated, and a method of constructing the same.

The present invention is also directed to providing a non-welding type CFT column using a straight bolt connection slot capable of ensuring an efficient discharge path of steam pressure in concrete by forming a multi-perforated penetrating part on a column surface on which a connection slot of an external steel tube of the CFT column is not formed, and a method of constructing the same.

The present invention is also directed to providing a non-welding type CFT column using a straight bolt connection slot capable of stably ensuring a water transmission path in a multi-perforated penetrating part through concrete by further attaching a wave-shaped punching steel plate to an inner surface of an external steel tube having the multi-perforated penetrating part to reinforce concrete around the multi-perforated penetrating part, and a method of constructing the same.

According to an aspect of the present invention, there is provided a non-welding type CFT column using a straight bolt connection slot including external steel tubes including straight jointing portions in which inclined bolt grooves are formed to be vertically apart from each other and which are formed to extend from an end thereof to cover an overall extension length thereof, a straight bolt connection slot including straight plates connected by a connection bolt to be apart from each other and formed to extend, and configured to integrate the external steel tubes by allowing the connection bolt to be inserted into each of the inclined bolt grooves in which the straight jointing portions of the external steel tubes are in contact with each other and communicate with each other, and concrete placed in the integrated external steel tubes and cured.

The CFT column using a straight bolt connection slot may further include multi-perforated penetrating parts formed in the external steel tubes on which the straight jointing portions and the straight bolt connection slot are not formed.

The CFT column using a straight bolt connection slot may further include wave-shaped punching steel plates formed by forming punching steel plates adjacent to each other in a ⊏-shaped cross-section on inner surfaces of the external steel tubes having the multi-perforated penetrating parts formed therein to form a wave shape by reinforcing concrete around the multi-perforated penetrating parts to simplify a discharge path of steam pressure in concrete by an extension form and to prevent interference with a water discharge path using the multi-perforated penetrating parts.

The CFT column using a straight bolt connection slot may further include base plates formed on both ends of the external steel tubes.

The connection bolt may have bolt portions extending from the upper and lower inclined bolt grooves to oppose each other and ensure coupling performance with the concrete.

The straight bolt connection slot may be a vertical plate form in which straight plates are formed to face each other. The straight plates may be pre-assembled using the connection bolt, and the connection bolt of the pre-assembled straight bolt connection slot may be inserted into each of the inclined bolt grooves of the straight jointing portions in contact with each other so that the connection bolt is disposed parallel to heating surfaces of the external steel tubes.

According to another aspect of the present invention, there is provided a method of constructing a non-welding type concrete-filled steel tube (CFT) column using a straight bolt connection slot and a wave-shaped punching steel plate including (a) manufacturing a non-welding type CFT column using a straight bolt connection slot and a wave-shaped punching steel plate, wherein the non-welding type CFT column may include external steel tubes having straight jointing portions in which inclined bolt grooves are formed to be vertically apart and which extend from an end thereof from to cover an overall extension length thereof, a straight bolt connection slot (130) having straight plates connected to be apart from each other by a connection bolt and formed to extend, and allowing the external steel tubes to be integrated with each other by allowing the connection bolt to be inserted into the inclined bolt grooves in which the straight jointing portions of the external steel tubes are in contact with each other and communicate with each other, and concrete placed in the integrated external steel tubes and cured, and (b) vertically installing the manufactured non-welding type CFT column on the ground.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1A:
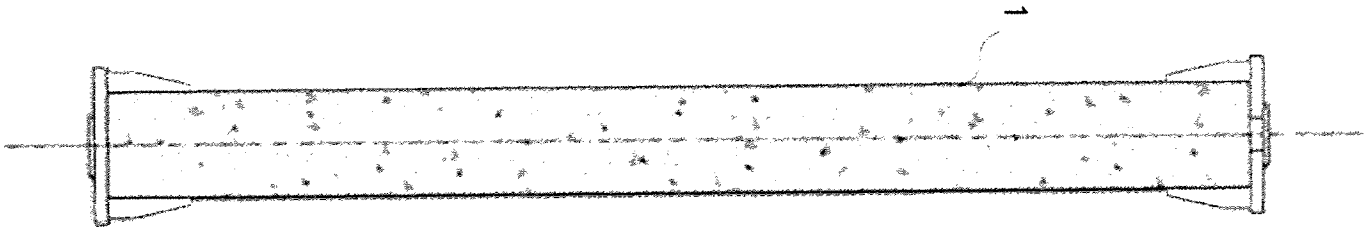
FIG. 1A (Prior Art)
FIG. 1A is a view illustrating a shape of a test specimen of a general concrete-filled steel tube (CFT) column.
Figure 1B:
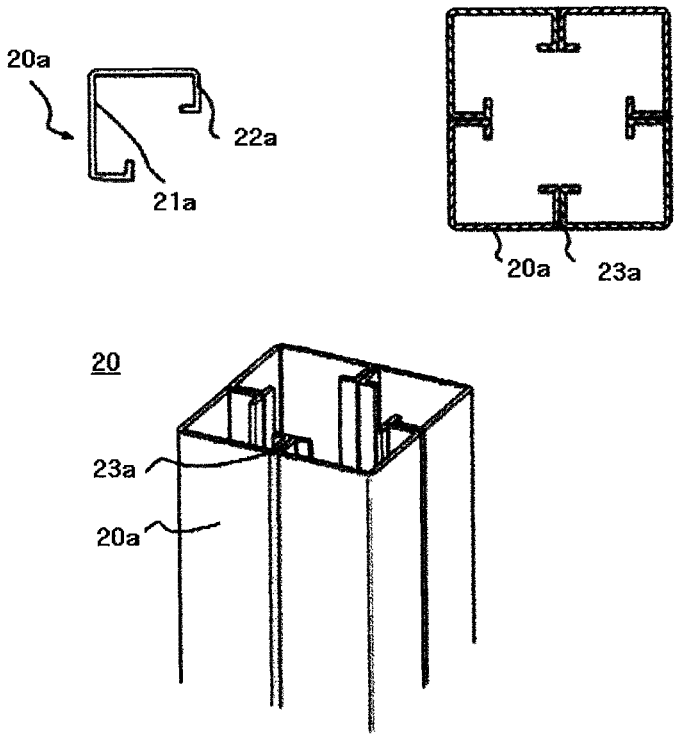
FIG. 1B (Prior Art)
FIG. 1B is a cross-sectional view of a centrifugal hollow rib steel tube CFT according to a conventional art.
Figure 1C:
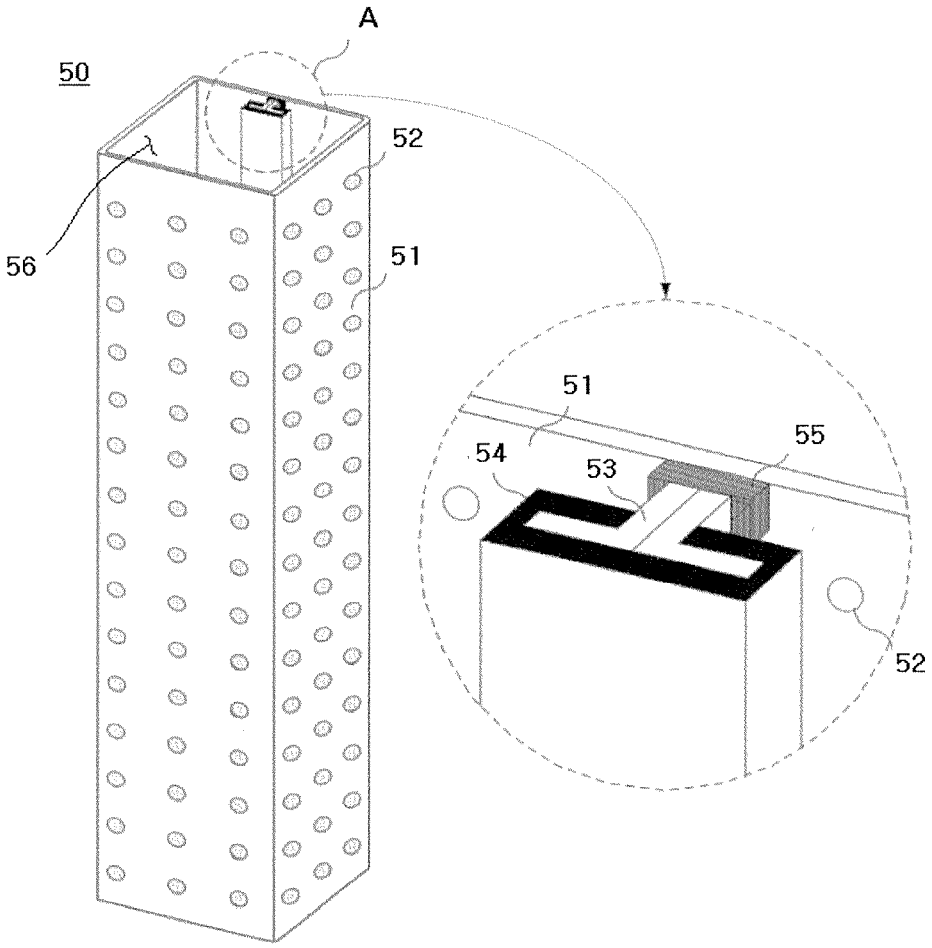
FIG. 1C (Prior Art)
FIG. 1C is a view of an example of a non-welding type CFT column using a slot according to a conventional art.
Figure 1D:
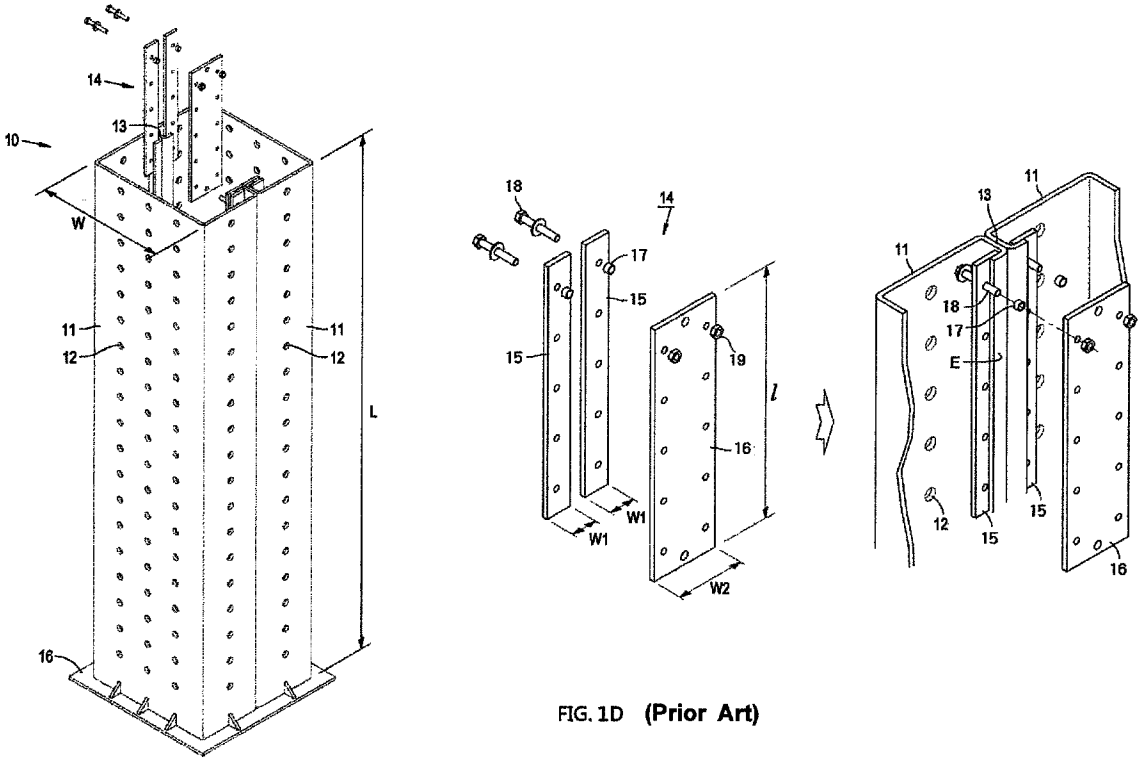
FIG. 1D (Prior Art)
FIG. 1D is a view illustrating an example of a non-welding CFT column using other slot according to a conventional art.

Hereinafter, embodiments that are easily performed by those skilled in the art will be described in detail with reference to the accompanying drawings. However, embodiments of the present invention may be implemented in several different forms, and are not limited to embodiments described herein. In addition, parts irrelevant to description are omitted in the drawings in order to clearly explain embodiments of the present invention. Similar parts are denoted by similar reference numerals throughout this specification.

Throughout the specification, when a portion "includes" an element, further inclusion of another element is not excluded unless otherwise described.

[A Straight Bolt Connection Slot of an Embodiment of the Present Invention]

Figure 2A:
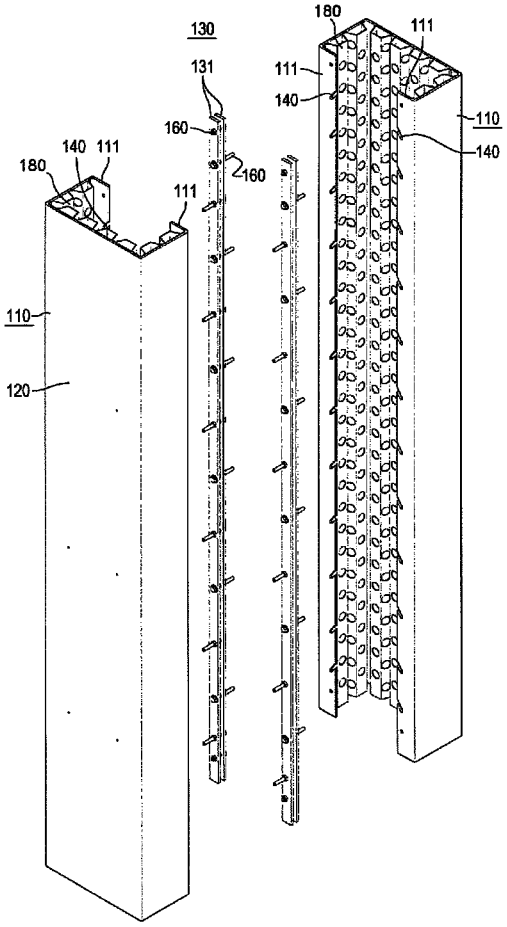
FIGS. 2A, 2B, and 2C are a configuration perspective view, an extracted sectional view, and a coupling configuration view illustrating a non-welding type CFT column using a straight bolt connection slot according to an embodiment of the present invention.
Figure 2B:
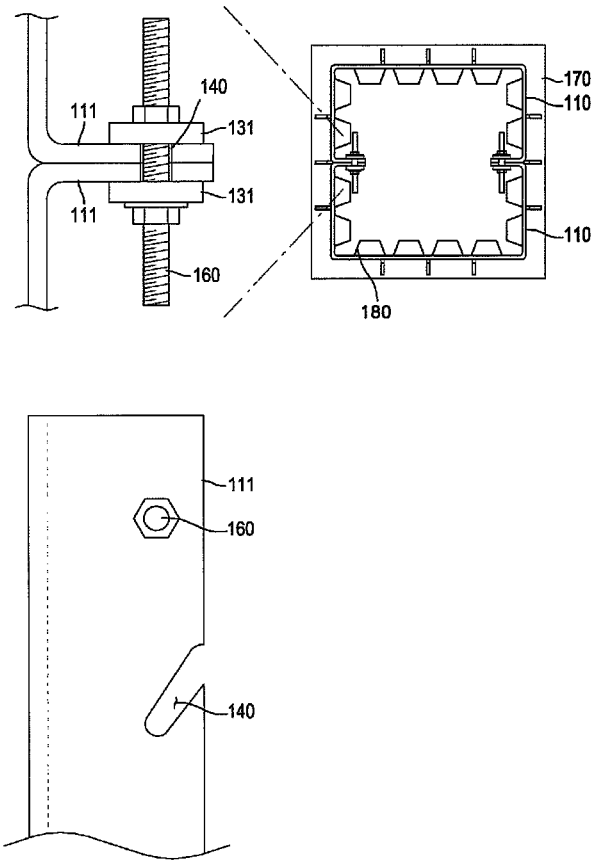
Figure 2C:
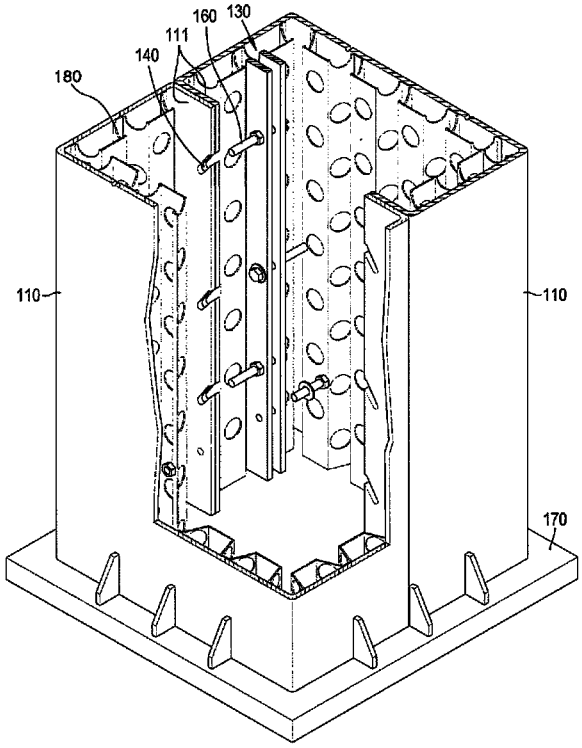
Figure 3A:
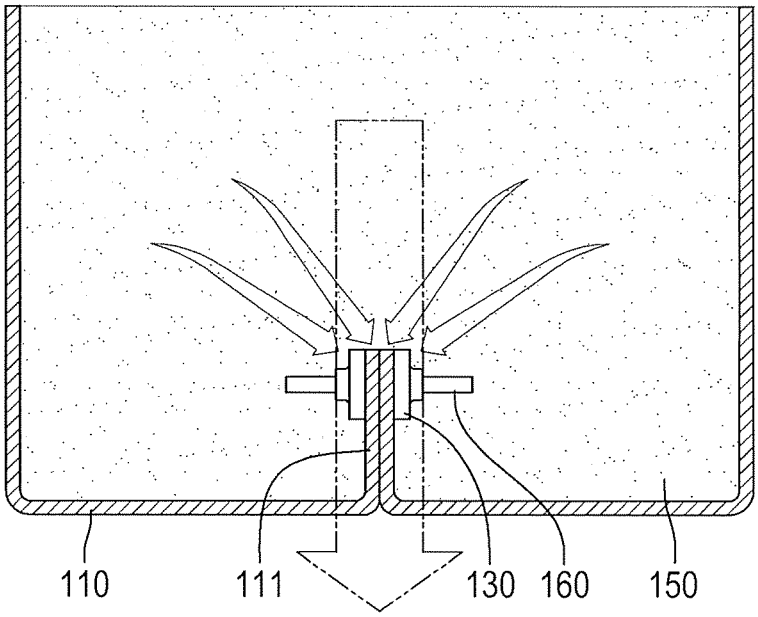
FIGS. 3A to 3B is a view illustrating examples of discharge paths of steam pressure in concrete of the conventional steel tube column and the non-welding type CFT column using a straight bolt connection slot according to the embodiment of the present invention.

FIGS. 2A, 2B and 2C are a configuration perspective view, an extracted sectional view, and a coupling configuration view illustrating a non-welding type CFT column using a straight bolt connection slot according to an embodiment of the present invention, and FIG. 3A is a view illustrating examples of discharge paths of steam pressure in concrete of the conventional steel tube column and the non-welding type CFT column using a straight bolt connection slot according to the embodiment of the present invention.

A non-welding type concrete-filled steel tube (CFT) column 100 using a straight bolt connection slot according to the embodiment of the present invention, as shown in FIGS. 2A, 2B and 2C, includes external steel tubes 110 having straight jointing portions 111 of the external steel tubes, multi-perforated penetrating parts 120, a straight bolt connection slot 130, inclined bolt grooves 140, concrete 150, a connection bolt 160, a base plate 170, and wave-shaped punching steel plates 180.

The external steel tubes 110, as shown in FIGS. 2A and 2B, are manufactured by coupling pairs of steel plates with a predetermined extension length L and a width W to each other to form hollow tube shapes. The shapes of the external steel tubes 110 may be rectangular, and the diameters of the external steel tubes 110 may be determined variously (for example, 500*500*3000 mm, 6 T, and SS400).

In this case, the straight jointing portions 111 of the external steel tubes formed by bending both ends of each steel plate at a right angle are processed to be retracted (protrude and extend toward the inside of the integrated external steel tubes).

Therefore, the straight jointing portions 111 are formed to extend to cover an overall extension length L of the external steel tubes 110.

The straight jointing portions 111 of the external steel tubes function as a connection unit connecting the external steel tubes 110 divided into two and also function, as shown in FIG. 3A, as a discharge path of steam pressure in concrete.

The straight jointing portions 111 of the external steel tubes in contact with each other, as shown in FIG. 2C, communicate with each other through the inclined bolt grooves 140 formed vertically with a predetermined angle.

Both of the external steel tubes 110 may be mutually integrated only by inserting a connection bolt 160 pre-installed into the straight bolt connection slot 130.

Since the straight jointing portions 111 may be formed by simply bending jointing ends of the external steel tubes 110 in a straight form, there is an advantage of remarkably reducing manufacturing and bending costs for the external steel tubes.

Here, the external steel tubes 110 further include multi-perforated penetrating parts 120 to discharge steam pressure in the concrete 150 generated in fire.

That is, the external steel tubes 110 include at least one multi-perforated penetrating part 120 which includes holes for discharging steam pressure in inner concrete that are formed vertically to prevent a pressure from increasing in fire, but the multi-perforated penetrating parts 120 are formed only in the external steel tubes 110 on which jointing portion 111 of the external steel tubes and the straight bolt connection slot 130 are not formed, thereby reducing effort and costs for forming the multi-perforated penetrating parts 120.

In this case, the diameter and the number of the multi-perforated penetrating parts 120 are controlled so that the filled concrete 150 is prevented from leaking to the outside through the multi-perforated penetrating parts 120.

Figure 3B:
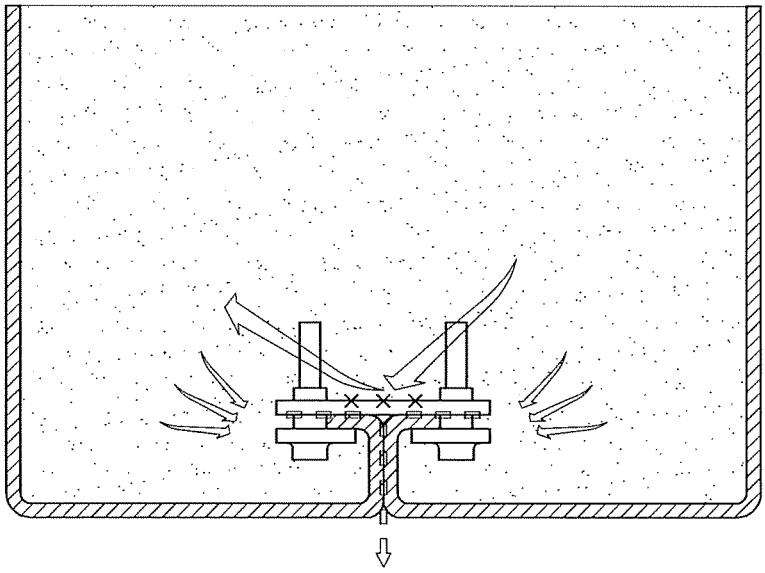
FIG. 3B (Prior Art)

Therefore, as shown in FIG. 3A, the straight bolt connection slot 130 inserted into the straight jointing portions 111 of the external steel tube has a discharge path of steam pressure in inner concrete which has a simpler structure than that of the conventional T-shaped connection slot (FIG. 3B), and thus the CFT column 100 can have increased fire resistance by ensuring the more efficient discharge path of steam pressure in inner concrete.

FIGS. 2A, 2B and 2C show that the straight bolt connection slot 130 has a vertical plate form in which two straight plates 131 face each other. The two straight plates 131 are formed apart from each other and coupled by the connection bolt 160.

Accordingly, the straight bolt connection slot 130 is pre-assembled by the connection bolt 160, and the installation work of the straight bolt connection slot 130 as a straight jointing portion of the external steel tube is remarkably simple.

The connection bolt 160 connects the straight jointing portions 111 in contact with each other, increases coupling performance of the concrete 150 (a kind of shear connector), and is disposed parallel to a heating surface, and thus the discharge path of steam pressure in concrete is simplified to remarkably efficiently ensure fire resistance.

Specifically, as shown in FIG. 2C, the inclined bolt grooves 140 are formed to communicate with each other in the straight jointing portions 111 of the external steel tubes, and installation of the straight bolt connection slot 130 at the straight jointing portion of the external steel tubes may be completed simply by inserting the connection bolt 160 of the pre-assembled straight bolt connection slot 130 into the inclined bolt groove 140.

Also, the connection bolt 160 inserted into the inclined bolt groove is inserted into the straight jointing portion to be inclined to be more efficiently prevented from escaping when the concrete 150 is placed.

Further, the jointing performance of jointing ends of the external steel tubes according to the number of connection bolts 160 installed may be easily controlled, and the external steel tubes 110 may be integrated in a non-welding manner.

Also, the connection bolts 160 inserted into the inclined bolt grooves 140 have bolt portions extending from the upper and lower inclined bolt grooves 140 to oppose each other (extend in opposite directions) to more efficiently ensure coupling performance with the concrete 150.

Also, the connection bolt 160 extends parallel to a heating surface of the external steel tube, as shown in FIG. 3A, so that the discharge path of the steam pressure in inner concrete is guided into the heating surface through the straight jointing portions 111 of the external steel tubes in contact with each other and the straight bolt connection slot 130.

Also, although local buckling of the external steel tubes 110 occurs in fire, in the CFT column 100 using a straight bolt connection slot according to the embodiment of the present invention, the bolt portions of the connection bolt 160 extend from the upper and lower inclined bolt grooves 140 to oppose each other, thus increasing resistance against local buckling, and thus the CFT column is deformed as slowly as possible, thereby ensuring structural performance and sufficiently ensuring fire resistance.

The concrete 150 is formed to be placed in the external steel tubes 110 and cured in a state in which the straight bolt connection slot 130 is inserted into the connection bolt 160. Specifically, a general aggregate defined in a general concrete specification is used for the concrete 150 with which the external steel tubes 110 are filled, for example, the design criterion strength of the concrete 150 ranges from 240 $kgf/cm^2$ to 400 $kgf/cm^2$. However, a result of fire resistance evaluation for concrete with a strength of 400 $kgf/cm^2$ obtained by a trusted authority may be applied.

The base plates 170 are further formed on one end surface of the external steel tube 110 to facilitate standing up by itself. It is preferable that the base plates 170 be formed on both ends of the external steel tubes 110 and be easily installed as a column member using a reinforcing piece.

The wave-shaped punching steel plates 180 are fixed and attached to inner surfaces of the external steel tubes 110 to surround concrete around the multi-perforated penetrating parts 120, thereby increasing coupling performance of the concrete 150 (a kind of shear connector). The wave-shaped punching steel plates 180 are disposed parallel to the heating surface, and concrete around the multi-perforated penetrating parts 120 at a portion at which the straight bolt connection slot 130 is not formed is reinforced, and thus the discharge path of steam pressure in concrete is simplified by the extension form, thereby preventing interference in the water discharge path using the multi-perforated penetrating parts 120.

"The wave-shaped punching steel plates with '⊏'-shaped cross-sections (also referred to C-shaped cross-sections), which are adjacent to each other, are installed on inner surfaces of the external steel tubes to have a wave form, and filling of concrete is easily performed through through holes."

The punching steel plates 180 are pre-formed in a wave shape and then are integrally fixed and attached to the external steel tubes 110, and thus quick attachment work is possible.

The CFT column 100 using a straight bolt connection slot according to an embodiment of the present invention, which is a CFT column allowing steam pressure in concrete to be discharged, is able to ensure fire resistance by efficiently removing and discharging the steam pressure in concrete. The straight jointing portions 111 are formed simply by being bent, and the straight bolt connection slot 130 in which the connection bolt 160 is pre-installed in the inclined bolt groove 140 of the straight jointing portions 111 is inserted into the inclined bolt groove 140, and thus the external steel tubes of the CFT column are able to be integrated simply.

[CFT Column 100 Using a Straight Bolt Connection Slot]

Figure 4:
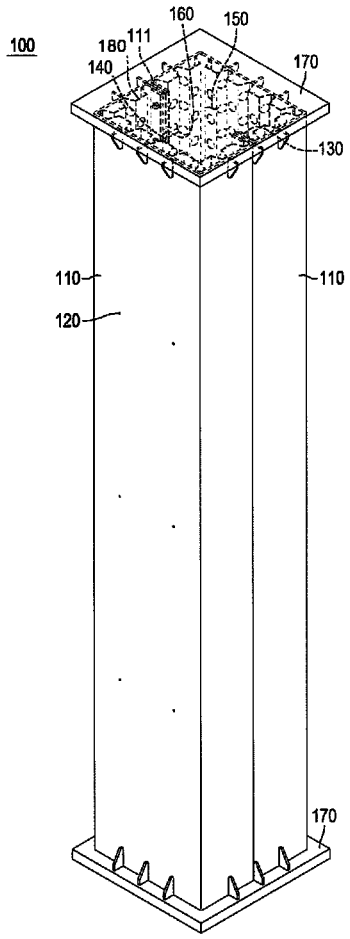
FIG. 4 is a perspective view illustrating the completed non-welding type CFT column using a straight bolt connection slot according to the embodiment of the present invention.

FIG. 4 is a perspective view illustrating the completed non-welding type CFT column using a straight bolt connection slot according to the embodiment of the present invention.

In the CFT column 100 using a straight bolt connection slot according to the embodiment of the present invention, the shape of the external steel tube 110 is rectangular, but the present invention is not limited thereto.

According to the CFT column using a straight bolt connection slot according to the embodiment of the present invention, the straight bolt connection slot 130 on which the retracted straight jointing portions 111 of the external steel tubes 110 filled with the concrete 150 are formed, the inclined bolt groove 140 and the connection bolt 160 are integrally manufactured to increase a coupling effect between the concrete 150 and the external steel tube 110.

Due to the coupling effect, the concrete 150 with relatively high fire resistance solves a problem of degradation of strength of the external steel tube 110 exposed to the outside in fire.

A process of manufacturing the CFT column 100 of the embodiment of the present invention is described below. The multi-perforated penetrating parts 120 are formed in the external steel tubes 110.

That is, the multi-perforated penetrating parts 120 are formed in the external steel tubes 110 on which the straight bolt connection slot 130 is not formed, and thus the steam pressure in concrete 150 generated in fire is discharged through the multi-perforated penetrating parts 120 as described above.

For example, the fire resistance of about 100 minutes is shown under a general load condition (a load ratio: 0.6), and the discharge path of steam pressure in inner concrete is efficiently guided to the outside to increase fire resistance. The plurality of multi-perforated penetrating parts 120 are separately formed in the external steel tubes on which the straight bolt connection slot is not formed to reduce manufacturing costs for CFT column.

Therefore, both ends of the external steel tube 110 are bent to be straight so that the straight jointing portion is retracted toward the inner side of the external steel tube, and the wave-shaped punching steel plates 180 may be attached and fixed.

Then, the connection bolt 160 pre-installed in the straight bolt connection slot 130 is inserted into each of the inclined bolt grooves 140 formed in the straight jointing portions 111 and is formed to extend horizontally.

Therefore, the external steel tubes 110 are jointed by the straight jointing portions 111, the straight bolt connection slot 130, the inclined bolt groove 140, and the connection bolt 160 in a non-welding manner.

Then, the concrete 150 is placed in the external steel tubes 110 through the straight bolt connection slot 130, the inclined bolt groove 140 and the connection bolt 160 and cured in a state in which the external steel tubes are integrated with each other, and the CFT column using a straight bolt connection slot is manufactured simply.

Finally, according to the CFT column using a straight bolt connection slot according to the present invention, the non-welding is conducted in a manner in which the jointing portions of the external steel tubes of the CFT column are straightly bent and retracted and then the connection bolt of the pre-installed straight bolt connection slot is inserted into the inclined bolt groove formed in the straight jointing portion.

Therefore, the welding process is omitted and construction time of the CFT column is reduced. Also, the limited multi-perforated penetrating parts are formed in the external steel tubes of the CFT column to ensure the fire resistance of the CFT column. Thus, the steam pressure in concrete can be efficiently removed.

[Method of Constructing a Concrete-Filled Steel Tube (CFT) Column Using a Straight Bolt Connection Slot]

A method of constructing a CFT column 100 using a straight bolt connection slot is described below.

First, the CFT column using a straight bolt connection slot and a wave-shaped punching steel plate is manufactured. The CFT column includes: external steel tubes 110 having straight jointing portions 111 in which inclined bolt grooves 140 are spaced to be vertically apart and which extend from an end thereof to cover an overall extension length thereof; a straight bolt connection slot 130 having straight plates 131 spaced apart from each other, connected by a connection bolt 160, and formed to extend, and allowing the external steel tubes to be integrated with each other by inserting the connection bolt 160 into the inclined bolt groove 140 in which the straight jointing portions 111 of the external steel tubes 110 are in contact with each other and communicate with each other; and concrete 150 placed in the integrated external steel tubes 110 and cured.

The CFT column is manufactured in a factory in advance, and the manufactured CFT column is carried onto a site.

Then, the manufactured non-welding CFT column is vertically installed on the ground, and thus the method of constructing the non-welding type CFT column using a straight bolt connection slot and a wave-shaped punching steel plate of the embodiment of the present invention may be completed.

A concrete-filled steel tube (CFT) column according to an embodiment of the present invention can be constructed in a non-welding manner and have increased fire resistance by simply assembling, manufacturing, and constructing a pair of external steel tubes of the CFT column, wherein the external steel tubes, for example, are manufactured as a pair of steel plates, and jointing portions of both external steel tubes are bent and retracted to be in contact with each other, and connection bolts integrally fastened with the straight bolt connection slot are inserted into inclined bolt grooves, which is formed to be vertically spaced apart from each other, in the joint portions of the external steel tubes so that the connection bolts are disposed parallel to a heating surface.

Therefore, the non-welding type CFT column using a straight bolt connection slot according to the embodiment of the present invention can allow a CFT column with excellent structural performance and fire resistance to be manufactured and can reduce construction time by omitting a welding process, can be easily manufactured because of a remarkably simple structure of the jointing portions of the external steel tubes, and can have more economically and efficiently increased fire resistance because a discharge path of steam pressure in concrete is ensured.

The non-welding type CFT column using a straight bolt connection slot according to the embodiment of the present invention can be efficient and economical because manufacturing costs of an external steel tube are reduced by forming multi-perforated penetrating parts on a limited column surface of the external steel tubes of CFT column.

The non-welding type CFT column using a straight bolt connection slot according to the embodiment of the present invention can stably ensure a water transmission path in the multi-perforated penetrating parts through concrete by reinforcing the concrete around the multi-perforated penetrating parts formed in the external steel tubes.

The above description of the present invention is only an example, and it will be understood by those skilled in the art that various modifications can be made without departing from the scope of the present invention and without changing essential features. Therefore, the above-described examples should be considered in a descriptive sense only and not for purposes of limitation. For example, each component described as a single type may be realized in a distributed manner, and similarly, components that are described as being distributed may be realized in a coupled manner.

The scope of the present invention is defined not by the detailed description but by the appended claims, and encompasses all modifications or alterations derived from meanings, the scope and equivalents of the appended claims.

DESCRIPTION OF SYMBOLS

100: CONCRETE-FILLED STEEL TUBE (CFT) COLUMN
110: EXTERNAL STEEL TUBE
111: STRAIGHT JOINTING PORTION
120: MULTI-PERFORATED PENETRATING PART
130: STRAIGHT BOLT CONNECTION SLOT
131: STRAIGHT SLOT
140: INCLINED BOLT GROOVE
150: CONCRETE
160: CONNECTION BOLT
170: BASE PLATE
180: WAVE-SHAPED PUNCHING STEEL PLATE

What is claimed is:

1. A non-welding type concrete-filled steel tube (CFT) column using a straight bolt connection slot and a wave-shaped punching steel plate, the non-welding type CFT column comprising:

external steel tubes including straight jointing portions in which inclined bolt grooves are formed to be vertically apart from each other and which are formed to extend from an end thereof to cover an overall extension length thereof;

the straight bolt connection slot including straight plates connected to each other by a plurality of connection bolts and extending from the end of the external steel tubes vertically, the straight plates connected to each other by the connection bolts, and configured to integrate the external steel tubes by allowing each of the connection bolts to be inserted into each of the inclined bolt grooves in which the straight jointing portions of the external steel tubes are in contact with each other and communicate with each other; and concrete placed in the integrated external steel tubes and cured, wherein the straight bolt connection slot is a vertical plate form in which the straight plates are formed to face each other, wherein the straight plates are pre-assembled using the connection bolts, and each of the connection bolts of the pre-assembled straight bolt connection slot is inserted into each of the inclined bolt grooves of the straight jointing portions in contact with each other so that the connection bolts are disposed parallel to heating surfaces of the external steel tubes.

2. The non-welding type CFT column of claim 1, further comprising multi-perforated penetrating parts formed at different portion of the external steel tubes with respect to the straight jointing portions.

3. The non-welding type CFT column of claim 2, further comprising the wave-shaped punching steel plate formed by forming a punching steel plate with a plurality of C-shaped cross-sections adjacent to each other on inner surfaces of the external steel tubes having the multi-perforated penetrating parts formed therein to form a wave shape by reinforcing concrete around the multi-perforated penetrating parts to simplify a discharge path of steam pressure in concrete by an extension form and to prevent interference with a water discharge path using the multi-perforated penetrating parts.

4. The non-welding type CFT column of claim 1, further comprising base plates formed on both ends of the external steel tubes.

5. The non-welding type CFT column of claim 1, wherein each of the connection bolts has bolt portions extending from the upper and lower inclined bolt grooves to oppose each other and ensures coupling performance with the concrete.

6. A method of constructing a non-welding type concrete-filled steel tube (CFT) column using a straight bolt connection slot and a wave-shaped punching steel plate, the method comprising:

(a) manufacturing a non-welding type CFT column using a straight bolt connection slot and a wave-shaped punching steel plate, wherein the non-welding type CFT column comprises: external steel tubes having straight jointing portions in which inclined bolt grooves are formed to be vertically apart and which extend from an end thereof to cover an overall extension length thereof; the straight bolt connection slot having straight plates connected to each other by a plurality of connection bolts and extending from the end of the external steel tubes vertically, the straight plates connected to each other by the connection bolts, and allowing the external steel tubes to be integrated with each other by allowing each of the connection bolts to be inserted into one of the inclined bolt grooves in which the straight jointing portions of the external steel tubes are in contact with each other and communicate with each other; and concrete placed in the integrated external steel tubes and cured; and (b) vertically installing the manufactured non-welding type CFT column on the ground.

* * * * *